US011810689B2

(12) United States Patent
Bois et al.

(10) Patent No.: US 11,810,689 B2
(45) Date of Patent: Nov. 7, 2023

(54) AC-COUPLING STRUCTURE IN ELECTRICAL CABLED INTERCONNECT

(71) Applicant: HEWLETT PACKARD ENTERPRISE DEVELOPMENT LP, Houston, TX (US)

(72) Inventors: Karl J. Bois, Ft. Collins, CO (US); James David Stewart, Ft. Collins, CO (US); David P. Kopp, Ft. Collins, CO (US); Elene Chobanyan, Ft. Collins, CO (US)

(73) Assignee: Hewlett Packard Enterprise Development LP, Spring, TX (US)

( * ) Notice: Subject to any disclaimer, the term of this patent is extended or adjusted under 35 U.S.C. 154(b) by 0 days.

(21) Appl. No.: 17/068,344

(22) Filed: Oct. 12, 2020

(65) Prior Publication Data

US 2022/0115166 A1 Apr. 14, 2022

(51) Int. Cl.

| | |
|---|---|
| ***H01B 11/06*** | (2006.01) |
| ***H01B 11/18*** | (2006.01) |
| ***H01P 3/06*** | (2006.01) |
| ***H01B 13/016*** | (2006.01) |
| *H01R 12/75* | (2011.01) |
| *H01R 12/72* | (2011.01) |

(52) U.S. Cl.

CPC ..... *H01B 11/1808* (2013.01); *H01B 11/1856* (2013.01); *H01B 13/0167* (2013.01); *H01P 3/06* (2013.01); *H01R 12/722* (2013.01); *H01R 12/75* (2013.01)

(58) Field of Classification Search

CPC ..... H01B 11/06

See application file for complete search history.

(56) References Cited

U.S. PATENT DOCUMENTS

| | | | | |
|---|---|---|---|---|
| 5,276,415 | A | 1/1994 | Lewandowski et al. | |
| 6,207,901 | B1 * | 3/2001 | Smith | H01P 1/30 174/102 R |
| 6,383,858 | B1 | 5/2002 | Gupta et al. | |
| 6,452,105 | B2 * | 9/2002 | Badii | H01B 11/1808 174/102 R |
| 6,496,353 | B1 | 12/2002 | Chio | |
| 9,046,342 | B2 * | 6/2015 | Xiao | G01B 15/06 |
| 9,960,810 | B1 | 5/2018 | He | |
| 11,476,016 | B2 * | 10/2022 | Jenner | H01B 11/085 |
| 2004/0251042 | A1 * | 12/2004 | Weiner | G01R 33/285 174/36 |

(Continued)

*Primary Examiner* — Chau N Nguyen

(74) *Attorney, Agent, or Firm* — Yao Legal Services, Inc.

(57) ABSTRACT

A signal cable for an AC-coupled link, may include: a signal conductor; a dielectric surrounding the signal conductor; and a ground sheath having a conductive layer disposed at least partially around the conductor such that the dielectric is positioned between the ground sheath and the signal conductor, wherein the conductive layer comprises a first portion extending in a first direction along the cable and a second portion extending in a second direction, opposite the first direction, along the cable and further wherein the first and second portions of the conductive layer are separated from each other by a gap, the gap being dimensioned to provide a determined amount of capacitance in series in the ground sheath. The gap may form a complete separation between the first and second portions of the conductive layer.

16 Claims, 6 Drawing Sheets

(56) References Cited

U.S. PATENT DOCUMENTS

| | | | | |
|---|---|---|---|---|
| 2005/0264381 | A1 | 12/2005 | Grothen et al. | |
| 2007/0037419 | A1* | 2/2007 | Sparrowhawk .... | H01B 11/1008 439/98 |
| 2008/0204601 | A1 | 8/2008 | Wang et al. | |
| 2012/0181079 | A1 | 7/2012 | Wittkop | |
| 2015/0318599 | A1 | 11/2015 | Ivanov et al. | |
| 2020/0020462 | A1* | 1/2020 | Garrett ..... | H01B 1/04 |

* cited by examiner

AC-COUPLING STRUCTURE IN ELECTRICAL CABLED INTERCONNECT

DESCRIPTION OF RELATED ART

In high speed electrical channels and interconnects, the transmitter (TX) and receiver (RX) devices are often DC isolated from each other using AC-coupling capacitors. Conventional technologies utilize a capacitor connected in series in the signal path to serve as a DC blocker to allow the receiver to control its common mode voltage. The AC-coupling capacitor allows the high-frequency AC signal to pass while blocking the DC signal. However at higher data rates, the electrical degradation of signal performance due to this structure is more pronounced. The AC-coupling capacitors, their mounting pads and the associated PCB plated through holes (PTH), or vias, to connect them can cause appreciable electrical degradation.

Current data rate trends using Ethernet as an example show increases from 25.78125 to 53.125 to 106.25 Gb/s per differential pair. Increasingly, cabled interconnects are being equally used for external and internal linking of the electrical physical medium. However, even in such cases, the AC-coupling capacitors are generally included on the surrogate mounting PCBs used to transition from the cables to standard PCB technology.

BRIEF DESCRIPTION OF THE DRAWINGS

The present disclosure, in accordance with one or more various embodiments, is described in detail with reference to the following figures. The figures are provided for purposes of illustration only and merely depict typical or example embodiments.

The figures are not exhaustive and do not limit the present disclosure to the precise form disclosed.

DETAILED DESCRIPTION

Embodiments of the technology disclosed herein do not utilize in-series capacitors in the signal lines to provide an AC-coupled link. Instead, they provide a break in the ground path to provide a mechanism to block the DC. Embodiments may be implemented that intentionally create a physical ground break in the sheath of the cable to provide DC blocking for the signal path.

To provide a clean path for AC current propagation at higher frequencies, the shape of the break may be formed as an interdigitated capacitor or otherwise have a castellated or nonlinear shape of some form. The interdigitated or castellated nature of the ground cutout can provide an effective capacitor value to provide acceptable high pass filter properties comparable to those normally provided by placing a physical capacitor in series with the signal line on a PCB or in a cable connector. Although the feature can be positioned at any longitudinal point along the cable, in some embodiments, it may be located at or near one of the ends where the structure can be further ruggedized (e.g., by a strain relief or other physical reinforcement) to prevent variation in the structure performance that might otherwise occur due to flexing of the cable. The ruggedized structure can also be further shielded to address EMI concerns that may arise.

In applications where cables are extruded as a continuous metal shape, this feature can be etched out of the fabricated cable. Because the AC-coupling capacitors can be omitted, embodiments may be configured to meet the same low frequency requirements, reduce the total end to end channel degradation, reduce the Bill of Materials (BOM) cost due to lack of physical discrete capacitors and free up PCB real-estate.

Figure 1:
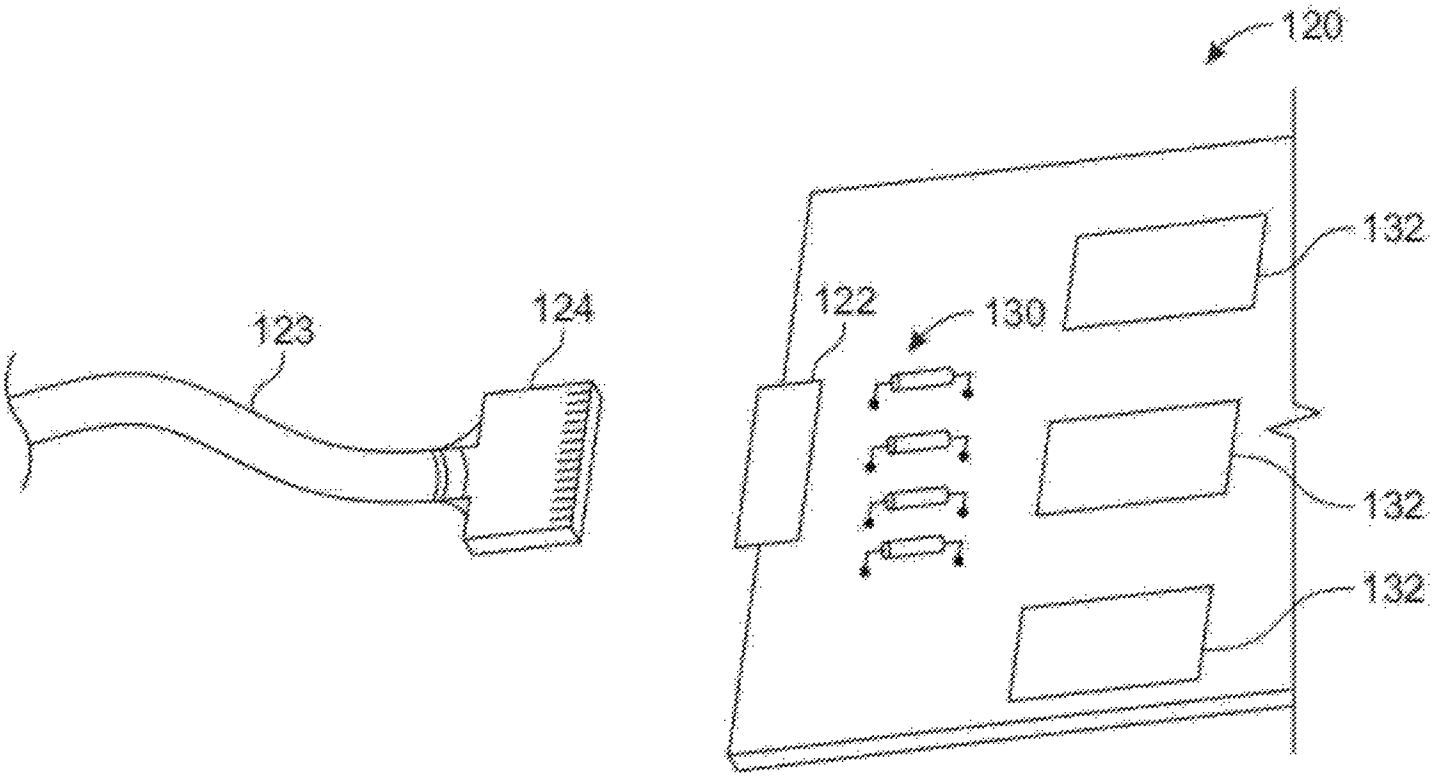
Fig. 1 (Prior Art)
FIG. 1 illustrates an example of a conventional technique for implementing AC coupled links using capacitors in line with AC signal paths.

FIG. 1 illustrates an example of a conventional technique for implementing AC coupled links using capacitors in line with AC signal paths. This example is provided in terms of a circuit board 120 that interfaces with a signal cable 123 via a card connector 122 and a corresponding cable-and connector 124. In this example, printed circuit board 120 includes a plurality of circuit modules 132 which may include, for example, integrated circuit components, discrete components, or other components. Although this example is described in terms of a printed circuit board 120, AC coupling capacitors can be used in any of a plurality of different implementations including, for example, with multichip modules, single-chip circuits, or other circuits. Although four AC coupling capacitors 130 are illustrated, implementations may contain a greater or lesser quantity of capacitors. In various implementations, AC coupling capacitors 130 may also be referred to as DC blocking capacitors.

This example includes a plurality of AC coupling capacitors 130 that are connected in series between their corresponding signal lines of signal cable 123 (e.g., via connectors 122, 124) and their corresponding termination points (e.g., circuits 132) on printed circuit board 120. One or more of AC coupling capacitors 130 may be connected to signal paths on different layers of printed circuit board 120 by way of flow-through holes, or vias. AC coupling capacitors 130 are used to couple AC signals between their respective signal lines of signal cable 123 and their corresponding components on printed circuit board 120. When connected to a load, such as a circuit on printed circuit board 120, each AC coupling capacitor 130, in conjunction with the impedance of the load, forms a high-pass filter that allows AC signals to pass while blocking low frequency signals. Because AC coupling capacitors 130 are able to block low frequencies, including DC, AC coupling capacitors 130 effectively block DC signals from passing, thereby passing only the AC signal. Accordingly, this capacitive coupling typically decreases the low-frequency gain of a system.

Figure 2:
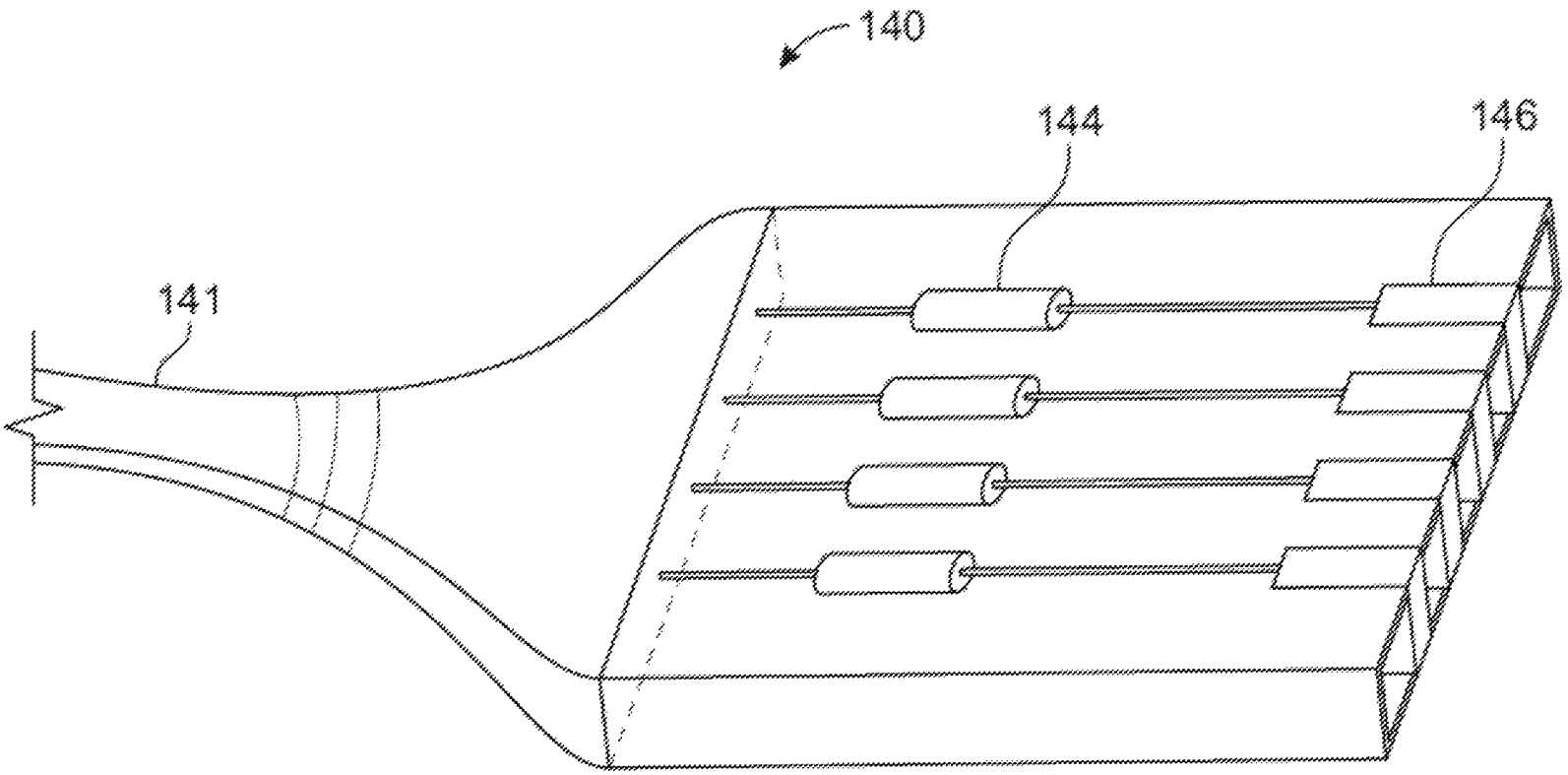
FIG. 2 illustrates another example technique for implementing AC coupled links using capacitors in line with AC signal paths.

FIG. 2 illustrates another example technique for implementing AC coupled links using capacitors in line with AC signal paths. In this example, AC coupling capacitors 144 are embedded within the body of a mating connector 140 and are connected in series in the AC signal links between the signal lines in signal cable 141 and the connectors 146 (e.g., pins or sockets) in connector 140. In this example, AC coupling capacitors 144 perform similarly to AC coupling capacitors 130 in the example of FIG. 1, allowing the AC signals to pass while blocking DC components.

Figure 3:
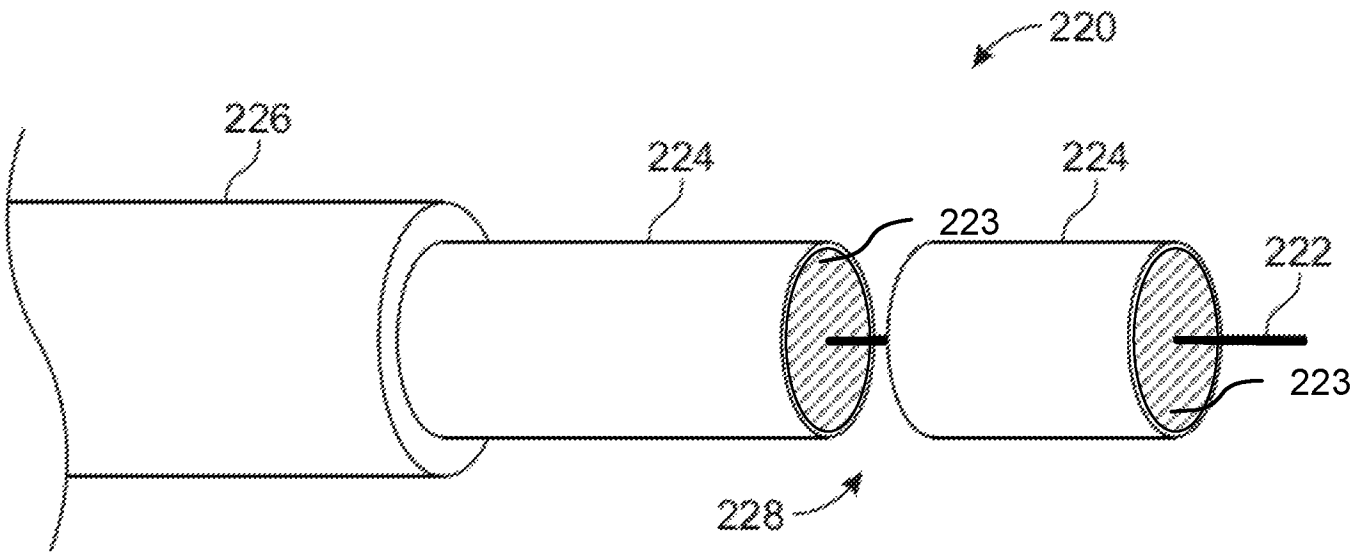
FIG. 3 illustrates an example implementation of using a break in a ground shield of a signal cable in place of a series-connected AC coupling capacitor in accordance with various embodiments.

FIG. 3 illustrates an example implementation of using a break in a ground shield of a signal cable in place of a series-connected AC coupling capacitor in accordance with various embodiments. This example illustrates a coaxial cable 220 including a metallic center conductor 222 to carry AC signals. A metallic cylindrical ground shield 224 is disposed around center conductor 222 to provide a path for the ground return and it may also shield the cable 220. A dielectric 223 or like material may be disposed between the outer cylindrical ground shield 224 and the center conductor 222. An insulating jacket 226 may be provided around ground shield 224.

This example illustrates a break 228 in the cylindrical ground shield 224. This break 228 may be provided as a physical separation partially or completely around the circumference of cylindrical ground shield 224. In embodiments, break 228 may be limited to a break in cylindrical ground shield 224, and either or both of the dielectric material 223 and insulating jacket 226 may remain continuous and unbroken. Providing this break 228 in the outer cylindrical ground shield 224 provides a break in the ground continuity, removing the pure DC component. This break 228 introduces a determined amount of capacitance (the amount dependent upon the geometry of the break) to effectively filter out DC components from the signal carried by coaxial cable 220. Accordingly, embodiments may be implemented without the need for adding a discrete component (e.g., a discrete capacitor) in the signal path to provide the AC coupling and DC filtering. The geometry (e.g., shape and dimensions) of the break may be selected to achieve the desired capacitance level, and hence, the filter characteristics. For example, embodiments may be implement to have a high pass cutoff frequency from about 1 MHz to 1 GHz, although other values can be achieved. The cutoff frequency varies with the protocol and data rate, so capacitance values may be selected accordingly. Representative values of capacitance to achieve such range could be 0.01 uF to 10 pF. For the data rates and protocols targeted at about 100 Gbit per second (per differential pair), for example, the cutoff frequency could reside in the single digit gigahertz values.

The break 228 in the cylindrical ground shield 224 can be provided using a number of different manufacturing techniques. For example, ground shield 224 can be chemically etched or laser etched, post manufacture, to form break 228 of a desired pattern and thickness. As another example, the ground shield 224 can be affixed in place in two pieces with the desired gap separation.

The example illustrated in FIG. 3 shows a straight, or linear, break 228 completely around the circumference of cylindrical ground shield 224. Other shapes of the break 228 can be provided in various embodiments to achieve different performance effects. For example, providing an irregular shape for the break 228 may achieve a larger amount of capacitance. Although the example in FIG. 3 is illustrated and described in terms of a coaxial cable with a single center conductor and a cylindrical shield, embodiments may be implemented with other cable types. For example, embodiments may be implemented with coaxial, triaxial quadraxial, twinaxial, and other cable types.

Figure 4:
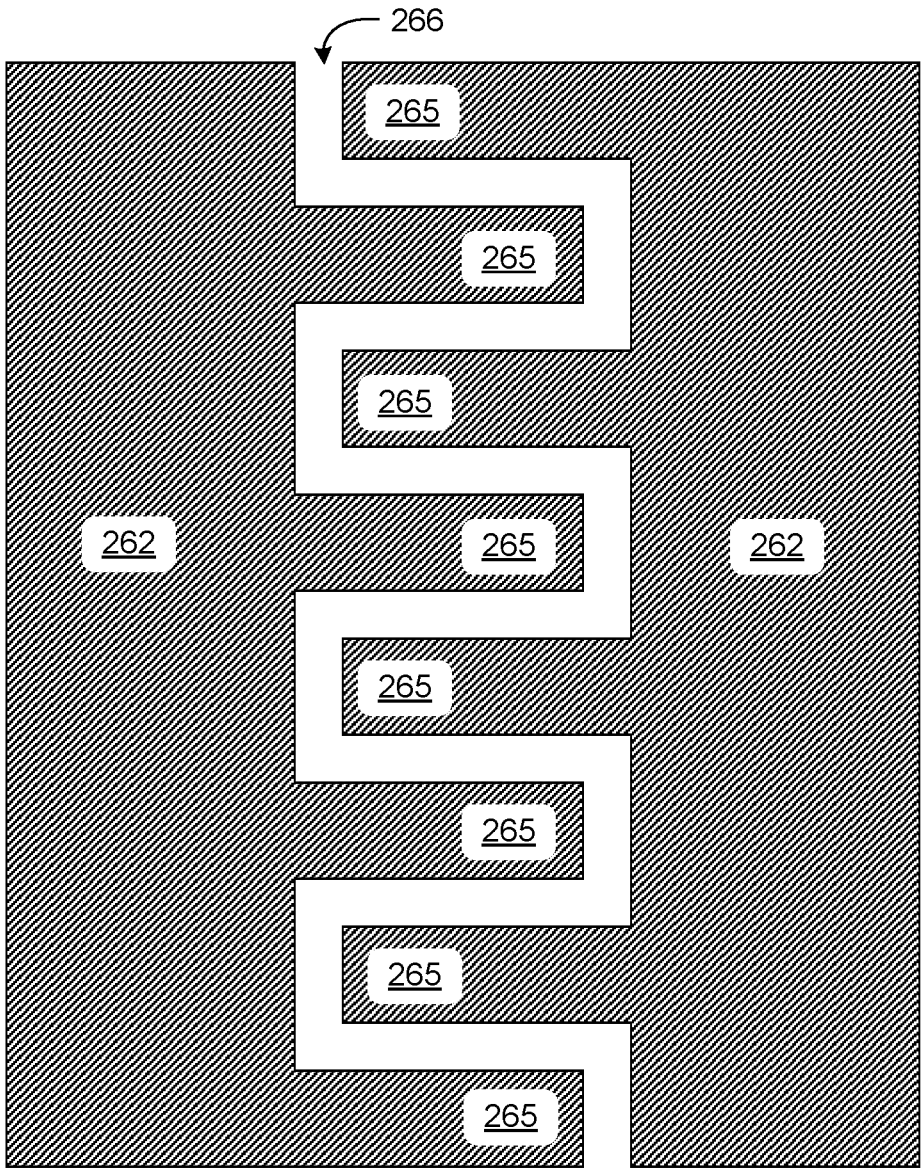
FIG. 4 illustrates an example segment of a break in the form of an interdigital capacitor in accordance with various embodiments.
Figure 5:
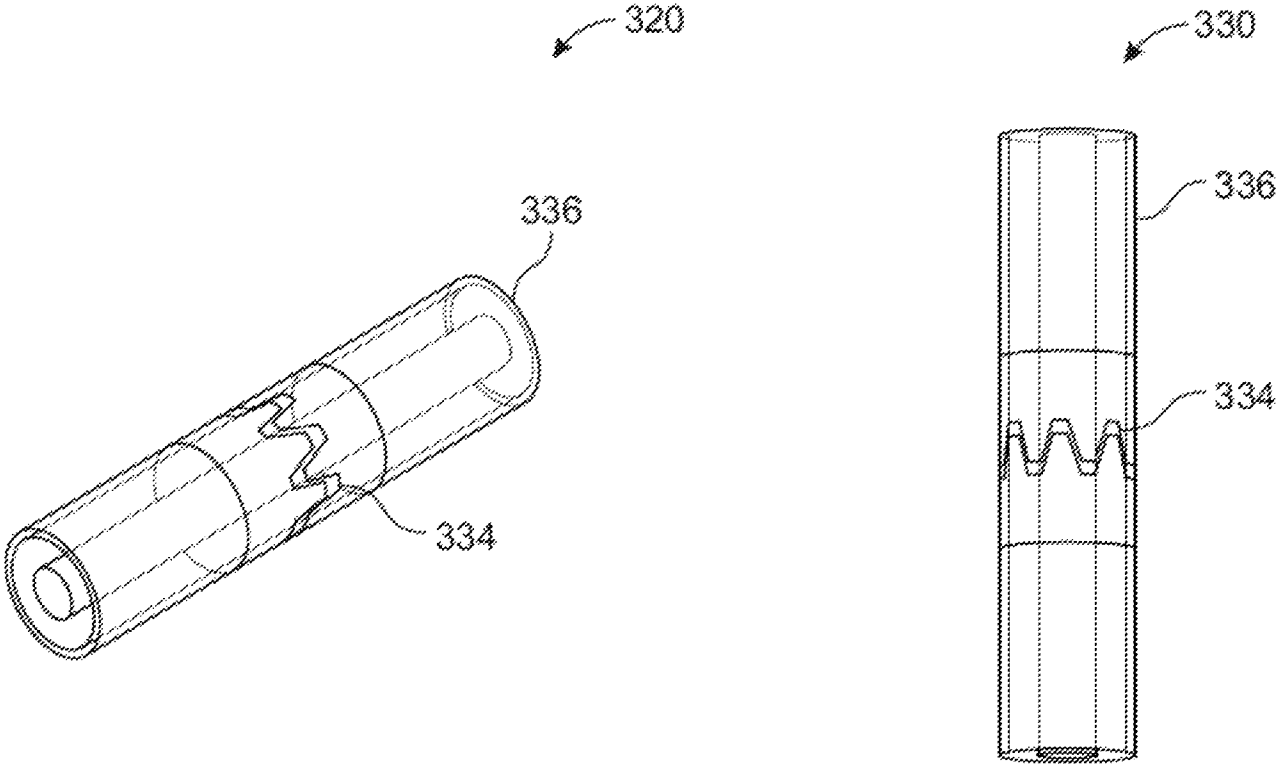
FIG. 5 illustrates an example configuration of a cylindrical ground sheath with a break wrapped around a center conductor.

FIG. 4 illustrates an example segment of a break in the form of an interdigital capacitor in accordance with various embodiments. In this example, a portion of the ground sheath 262 (e.g., ground sheath 244) is illustrated at the area of the break (e.g., break 228) where the capacitance is created in the ground sheath 262. In this case, the break is formed by a series of conductive interlaced fingers 265 separated by a space 266 to form an interdigital capacitor. Ground sheath 262 is illustrated as "flattened out" but normally would be formed in a cylindrical or like fashion so that it can be positioned around the center conductor of the cable (as shown in FIG. 5). Capacitance of the break in this configuration can be adjusted by adjusting parameters such as, for example, one or more of the parameters such as quantity, length and width of fingers 265 and the amount (e.g., width) of spacing 266. In various applications, interdigitating the capacitive element may preserve more consistent electrical behavior as compared to embodiments in which the gap is formed by shield portions having opposed linear edges arranged in parallel to one another. Representative dimensions for an interdigital capacitor could be, for example, a length of 16 mils, a width of the fingers of 4 mils and a spacing of 4 mils. In other examples, the length can range from 8-24 mils, the width of the fingers can range from 1-8 mils and the spacing can range from 1-8 mils. Other dimensions may also be applied depending on the capacitance level sought and the manufacturing tolerances and reliabilities desired. These dimensions are examples only.

FIG. 5 illustrates an example configuration of a cylindrical ground sheath with a break wrapped around a center conductor. View 320 illustrates an isometric view and view 330 illustrates a straight-on view. In this example, the break 334 in the ground sheath 336 is illustrated as being roughly sinusoidal in shape, but it could take other shapes. As with the interdigital example illustrated in FIG. 4, the amount of capacitance provided by the break 334 can vary as a function of parameters such as quantity and geometry of the complementary shapes that form the sinusoidal break 334 in the ground shield 336.

Figure 6:
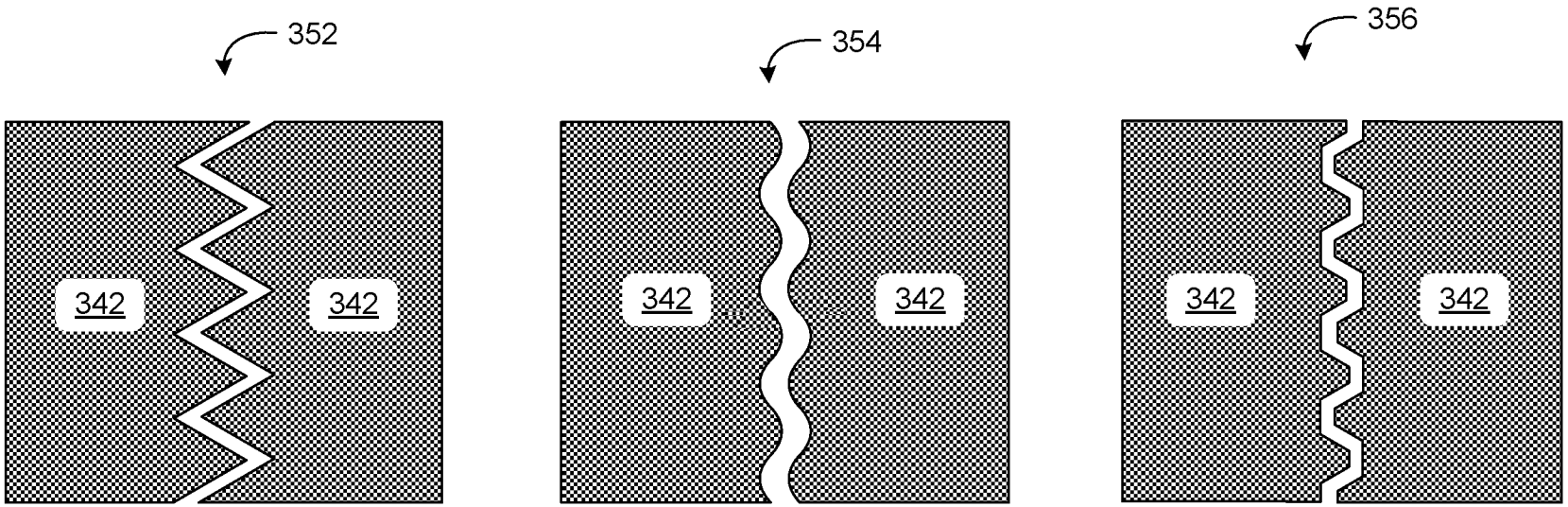
FIG. 6 illustrates a few example configurations for a break in the ground sheath to provide capacitance.

FIG. 6 illustrates three example configurations for a break in the ground sheath to provide capacitance. View 352 illustrates a break in the ground sheath 342 formed by a series of triangles interlaced or interwoven to provide a capacitance between the two portions of the sheath 342. View 354 illustrates a break in ground sheath 342 formed by a sinusoidal patterns of complementary wave-like shapes to provide a capacitance between the two portions of the sheath 342. In this example, the respective edges of the ground sheathes 342 are formed with a sinusoidal pattern. View 356 illustrates a break in ground sheath 342 formed by a series of complementary clipped triangles interlaced to provide a capacitance between the two portions of ground sheath 342. An example spacing can be implemented with a break of 20-200 microns, with one example being 100 microns. Other spacings can be provided depending on the capacitance desired in the manufacturing tolerances and reliabilities desired.

As with the example illustrated in FIG. 4, parameters such as dimensions, geometry and quantities of the patterns used to create the shape of the break can be adjusted to adjust capacitance presented by the break. For example, one or more of the height, width and quantity of features (e.g. triangles, waves and clipped triangles) can be adjusted to adjust the capacitance, as can the spacing between the two portions of the ground sheath 342.

In various embodiments, enhancements may be included to increase or fine tune the capacitance provided by the gap. For example, embodiments may be implemented in which materials are sputtered or otherwise deposited in the area of the gap to affect the amount of charge of the capacitance. Examples may include materials with very high dielectric constants that may be provided in the gap region to increase the capacitance of the gap. Such materials may include any of a number of different ceramics, including carbon loaded ceramics, glass, mica, oxides, etc. The amount and density of the material provided as well as material type can be selected to achieve a desired amount of capacitance introduced by the gap.

Embodiments may include a signal cable for an AC-coupled link, that includes: a signal conductor; a dielectric surrounding the signal conductor; and a ground sheath having a conductive layer disposed at least partially around the conductor such that the dielectric is positioned between the ground sheath and the signal conductor, wherein the conductive layer comprises a first portion extending in a first direction along the cable and a second portion extending in a second direction, opposite the first direction, along the cable and further wherein the first and second portions of the conductive layer are separated from each other by a gap, the gap being dimensioned to provide a determined amount of capacitance in series in the ground sheath. The gap may form a complete separation between the first and second portions of the conductive layer.

The first conductive portion may include an edge defining a first side of the gap and the second conductive portion may include an edge defining a second side of the gap. In various embodiments, the first edge and the second edge may be straight and arranged parallel to one another. In other embodiments, the first edge and the second edge may each include a plurality of elongate conductive members extending like fingers from their respective edges, and the first edge and the second edge may be positioned to create the gap and to form an interdigital capacitor.

As used herein, the term "or" may be construed in either an inclusive or exclusive sense. Moreover, the description of resources, operations, or structures in the singular shall not be read to exclude the plural. Conditional language, such as, among others, "can," "could," "might," or "may," unless specifically stated otherwise, or otherwise understood within the context as used, is generally intended to convey that certain embodiments include, while other embodiments do not include, certain features, elements and/or steps.

Terms and phrases used in this document, and variations thereof, unless otherwise expressly stated, should be construed as open ended as opposed to limiting. Adjectives such as "conventional," "traditional," "normal," "standard," "known," and terms of similar meaning should not be construed as limiting the item described to a given time period or to an item available as of a given time, but instead should be read to encompass conventional, traditional, normal, or standard technologies that may be available or known now or at any time in the future. The presence of broadening words and phrases such as "one or more," "at least," "but not limited to" or other like phrases in some instances shall not be read to mean that the narrower case is intended or required in instances where such broadening phrases may be absent.

What is claimed is:

1. A coaxial cable, comprising:

a continuous signal conductor carrying signals;

a dielectric layer surrounding and in direct contact with the signal conductor; and a ground sheath providing a ground return path to the signals carried by the signal conductor, wherein the ground sheath comprises a conductive layer disposed at least partially around the signal conductor such that the dielectric layer is positioned between the ground sheath and the signal conductor, wherein the conductive layer of the ground sheath and the dielectric layer each comprise a single gap separating a first continuous portion and a second continuous portion of the conductive layer and the dielectric layer, the single gap being filled with a material comprising carbon loaded ceramic or mica and dimensioned such that a distance between a first edge of the first continuous portion and a second edge of the second continuous portion is between 20 and 200 microns, thereby creating a capacitance between 0.01 μF and 10 pF in the ground return path to block propagation of direct current (DC) signals in the coaxial cable.

2. The coaxial cable of claim 1, wherein the single gap comprises a complete separation between the first and second continuous portions of the conductive layer and the dielectric layer.

3. The coaxial cable of claim 2, wherein a length of a respective elongate conductive member ranges between 8 and 24 mils, and wherein a width of the respective elongated conductive member ranges between 1 and 8 mils.

4. The coaxial cable of claim 1, wherein the first edge and the second edge each comprise a plurality of elongate conductive members extending from their respective edges, and the first edge and the second edge are positioned on opposite sides of the single gap and are positioned to form an interdigital capacitor.

5. The coaxial cable of claim 1, wherein the first edge and the second edge each comprise a plurality of triangular-shaped conductive members extending from their respective edges, and the first edge and the second edge are positioned to interweave the triangular-shaped conductive members.

6. The coaxial cable of claim 5, wherein the triangular-shaped conductive members comprise clipped-triangle shapes.

7. The coaxial cable of claim 1, wherein the first edge and the second edge each comprise a sinusoidal edge.

8. The coaxial cable of claim 1, further comprising multiple signal conductors surrounded by the dielectric layer.

9. The coaxial cable of claim 1, wherein the signal cable provides AC coupling and DC blocking without using a discrete capacitor in line with the signal conductor.

10. A coaxial cable comprising:

a continuous center conductor to carry signals;

a metallic cylindrical ground shied layer wrapping around the center conductor to provide a ground return path to the signals; and a continuous dielectric layer positioned between the center conductor and the metallic cylindrical ground layer; and wherein the metallic cylindrical ground shied layer comprises a first continuous metallic portion, a second continuous metallic portion, and a single gap positioned between the first and second continuous metallic portions; wherein the single gap is filled with a material comprising carbon loaded ceramic or mica; and wherein at least one dimension of the single gap is between 20 and 200 microns, thereby creating a capacitance between 0.01 μF and 10 pF in the ground return path of the signals to block propagation of direct current (DC) signals in the coaxial cable.

11. The coaxial cable of claim 10, wherein the first continuous metallic portion comprises a first edge, wherein the second continuous metallic portion comprises a second edge, and wherein the single gap is between the first and second edges.

12. The coaxial cable of claim 11, wherein the first edge and the second edge each comprise a plurality of elongate conductive members extending from their respective edges, and the first edge and the second edge are positioned on opposite sides of the single gap and are positioned to form an interdigital capacitor.

13. The coaxial cable of claim 12, wherein a length of a respective elongate conductive member ranges between 8 and 24 mils, and wherein a width of the respective elongated conductive member ranges between 1 and 8 mils.

14. The coaxial cable of claim 11, wherein the first edge and the second edge each comprise a plurality of triangular-shaped conductive members extending from their respective edges, and the first edge and the second edge are positioned to interweave the triangular-shaped conductive members.

15. The coaxial cable of claim 14, wherein the triangular-shaped conductive members comprise clipped-triangle shapes.

16. The coaxial cable of claim 11, wherein the first edge and the second edge each comprise a sinusoidal edge.

* * * * *